US011825919B2

(12) United States Patent
Naka et al.

(10) Patent No.: US 11,825,919 B2
(45) Date of Patent: Nov. 28, 2023

(54) SLIDE FASTENER

(71) Applicant: YKK Corporation, Tokyo (JP)

(72) Inventors: Yasuhito Naka, Kurobe (JP); Rito Kobayashi, Taito-ku (JP); Leona Saito, Kurobe (JP)

(73) Assignee: YKK Corporation

( * ) Notice: Subject to any disclaimer, the term of this patent is extended or adjusted under 35 U.S.C. 154(b) by 67 days.

(21) Appl. No.: 17/766,133

(22) PCT Filed: Nov. 12, 2019

(86) PCT No.: PCT/JP2019/044412
§ 371 (c)(1),
(2) Date: Apr. 1, 2022

(87) PCT Pub. No.: WO2021/095139
PCT Pub. Date: May 20, 2021

(65) Prior Publication Data

US 2023/0121500 A1 Apr. 20, 2023

(51) Int. Cl.
*A44B 19/26* (2006.01)

(52) U.S. Cl.
CPC ..... *A44B 19/262* (2013.01)

(58) Field of Classification Search
CPC ..... A44B 19/262; A44B 19/38; A44B 19/36; A44B 19/60; A44B 19/388; A44B 19/24; Y10T 24/2593; Y10T 24/2595; Y10T 24/32
See application file for complete search history.

(56) References Cited

U.S. PATENT DOCUMENTS 4,078,279 A * 3/1978 Heimberger ..... A44B 19/38 24/434
4,221,026 A * 9/1980 Kanzaka ..... A44B 19/38 24/433
4,742,603 A * 5/1988 Kasai ..... A44B 19/38 24/433

(Continued)

FOREIGN PATENT DOCUMENTS

EP 0493787 12/1991
JP S45007845 Y 4/1970

(Continued)

OTHER PUBLICATIONS

Naka, Yasuhito; International Preliminary Report on Patentability for PCT/JP2019/044412, filed Nov. 12, 2019, dated May 17, 2022, 10 pgs.

(Continued)

*Primary Examiner* — Robert Sandy
*Assistant Examiner* — Rowland Do
(74) *Attorney, Agent, or Firm* — Taylor English Duma LLP

(57) ABSTRACT

A pull tab includes a pull tab main portion. A first base is sandwiched between a second base and the pull tab main portion to form a stack in which the second base, the first base and the pull tab main portion are stacked in this order. The pull tab main portion and the first base are configured such that the pull tab main portion moves rearward to cause rearward movement of the slider body as the stack is sandwiched by human fingers in its stack direction while the first insert has been not fully inserted inside the slider body.

15 Claims, 12 Drawing Sheets

(56) References Cited

U.S. PATENT DOCUMENTS

| | | | | |
|---|---|---|---|---|
| 6,088,888 | A * | 7/2000 | Oda | A44B 19/38 24/433 |
| 7,320,158 | B2 * | 1/2008 | Deto | A41F 1/002 24/433 |
| 8,813,319 | B2 * | 8/2014 | Ogura | A44B 19/382 24/434 |
| 8,910,352 | B2 * | 12/2014 | Nozaki | A44B 19/26 24/433 |
| 11,432,622 | B2 * | 9/2022 | Owings | A44B 19/06 |
| 2003/0213106 | A1 * | 11/2003 | Ichikawa | A44B 19/388 24/433 |
| 2005/0050699 | A1 | 3/2005 | Yoneoka | |
| 2010/0313387 | A1 * | 12/2010 | Peters | A44B 19/38 24/381 |
| 2017/0360160 | A1 * | 12/2017 | Kojima | A44B 19/26 |
| 2018/0000203 | A1 * | 1/2018 | Jin | A44B 19/04 |
| 2020/0015554 | A1 | 1/2020 | Takazawa et al. | |
| 2021/0007446 | A1 | 1/2021 | Ekko et al. | |
| 2022/0225740 | A1 * | 7/2022 | Tung | A44B 19/24 |

FOREIGN PATENT DOCUMENTS

| | | | |
|---|---|---|---|
| JP | H04231003 | A | 8/1992 |
| JP | 4152216 | B2 | 9/2004 |
| WO | 2011004500 | | 1/2011 |
| WO | 2015063927 | | 5/2015 |
| WO | 2018061208 | | 4/2018 |
| WO | 2019175944 | | 9/2019 |

OTHER PUBLICATIONS

Naka, Yasuhito; International Search Report and Written Opinion for PCT/JP2019/044412, filed Nov. 12, 2019, dated Dec. 24, 2019, 14 pgs.

* cited by examiner

[Fig. 1]
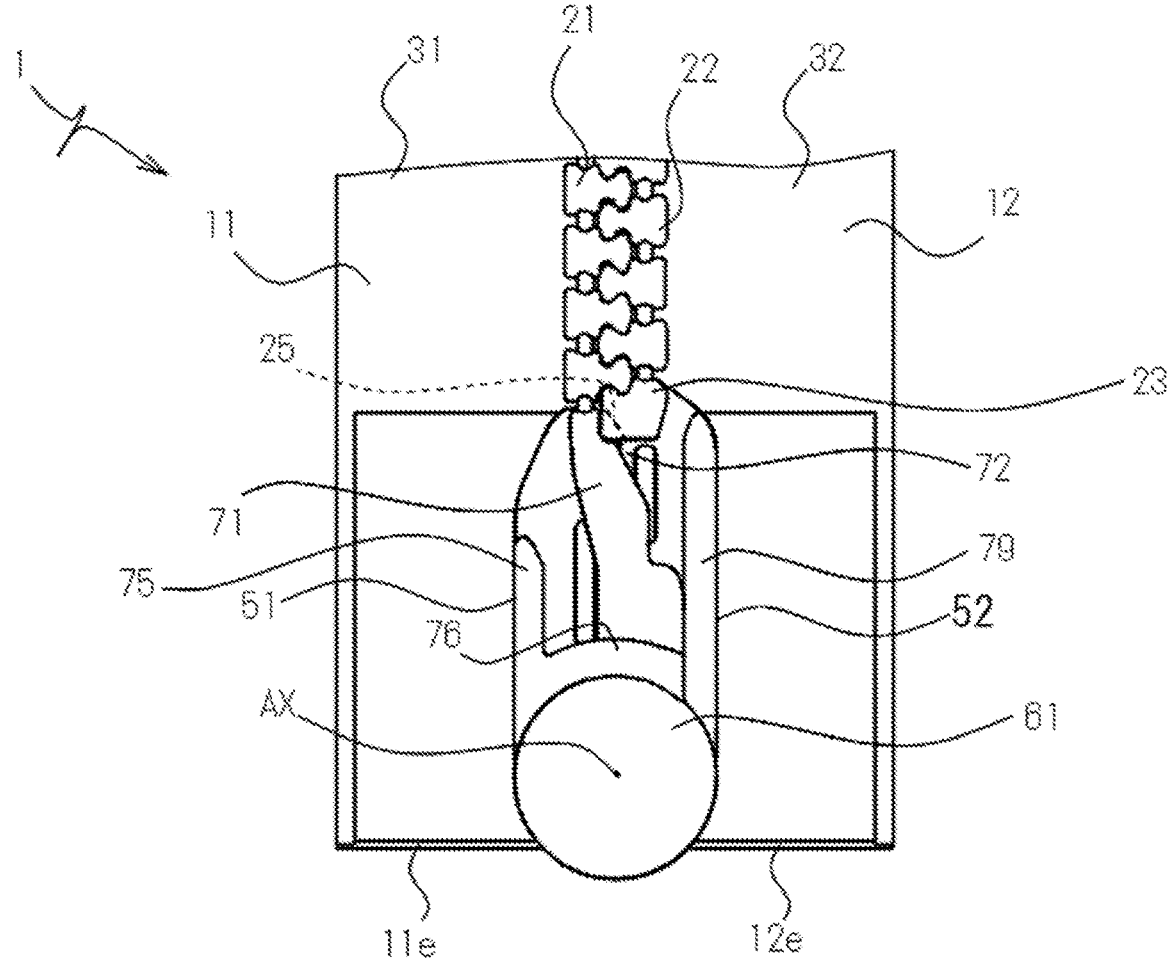

[Fig. 2]
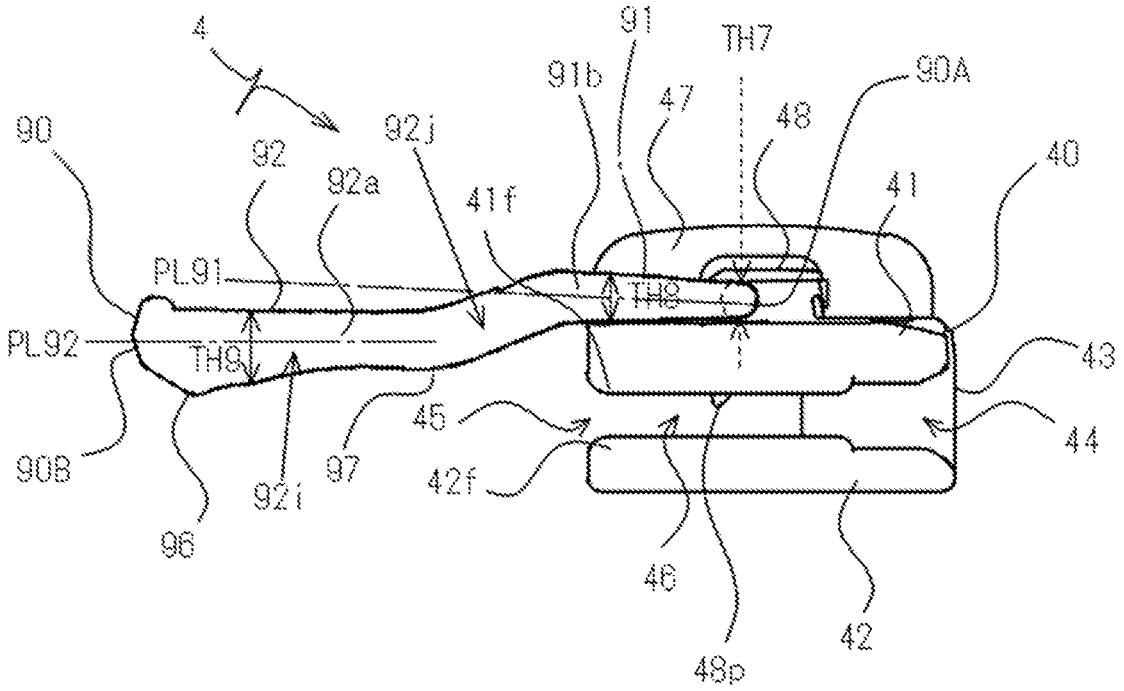

[Fig. 3]
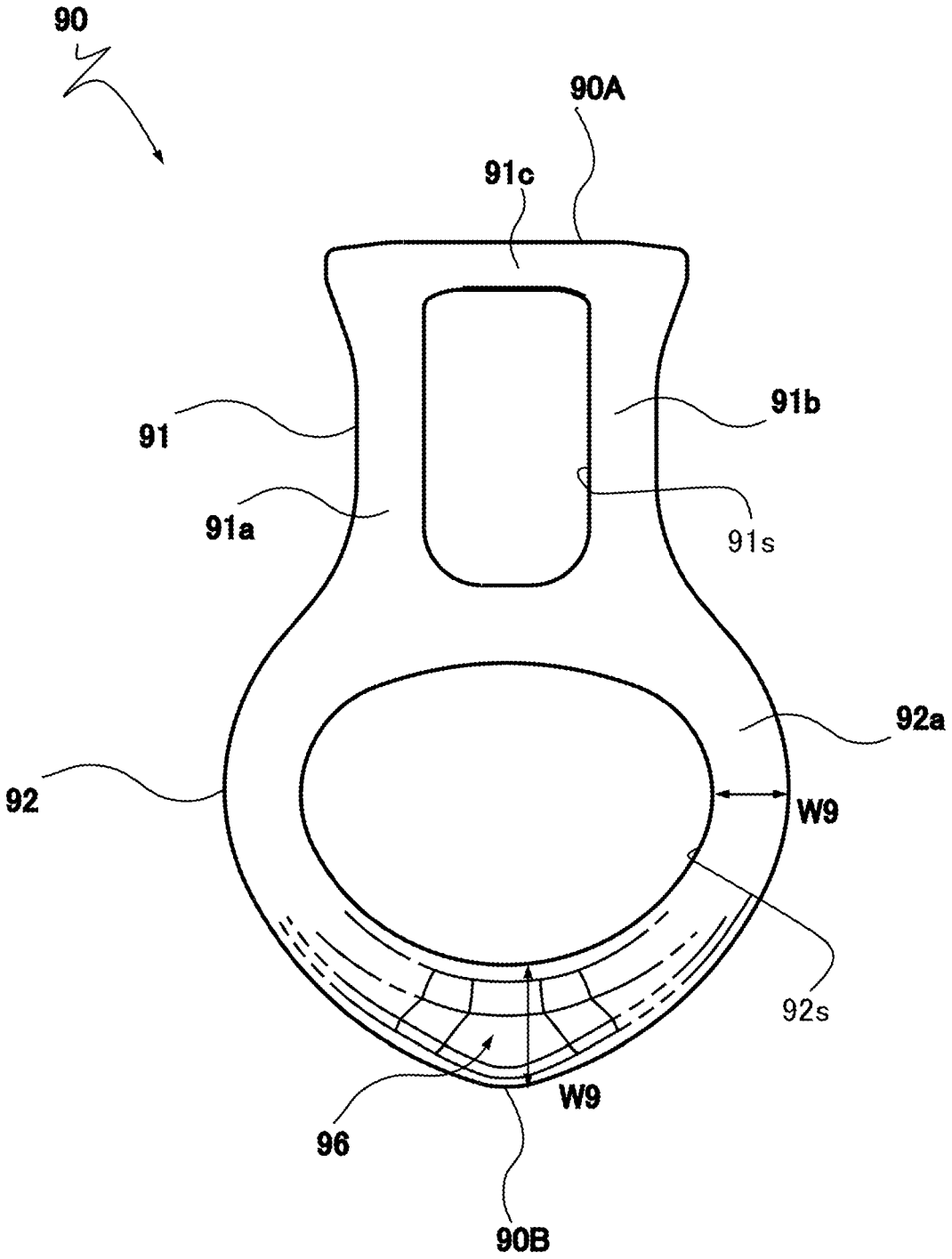

[Fig. 4]
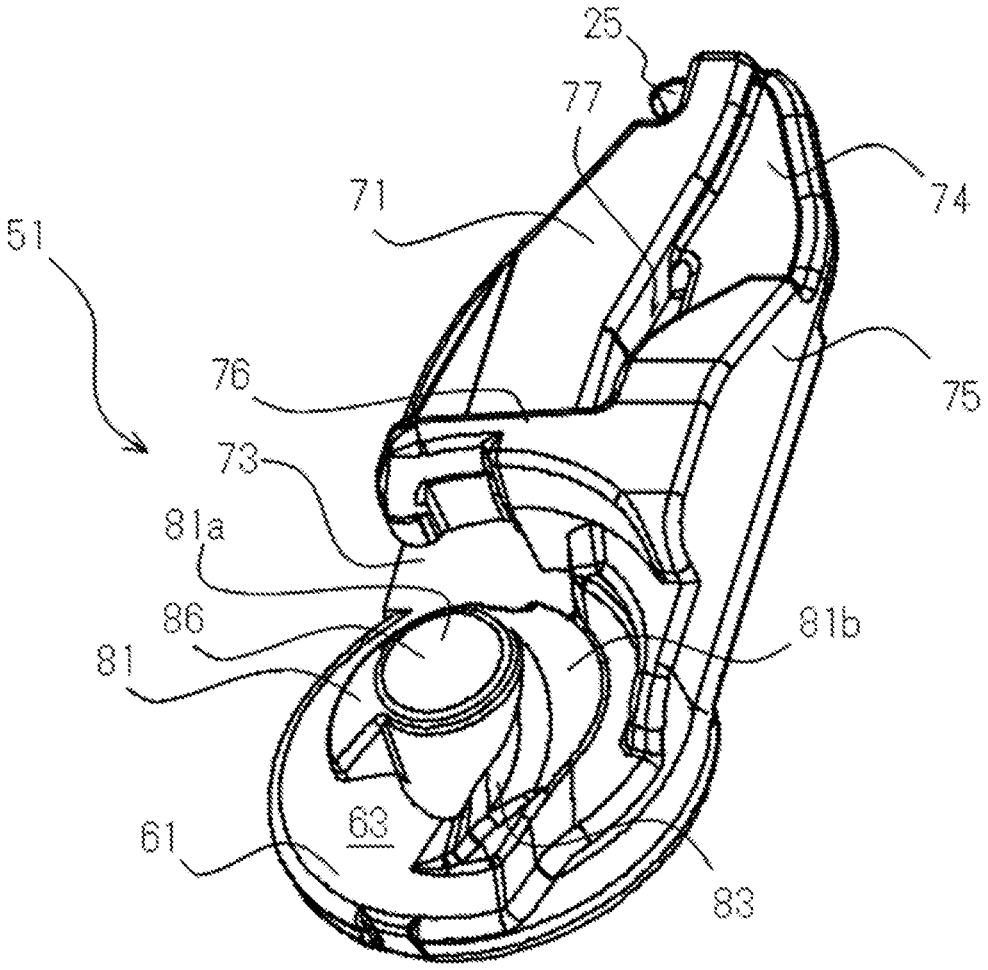

[Fig. 5]
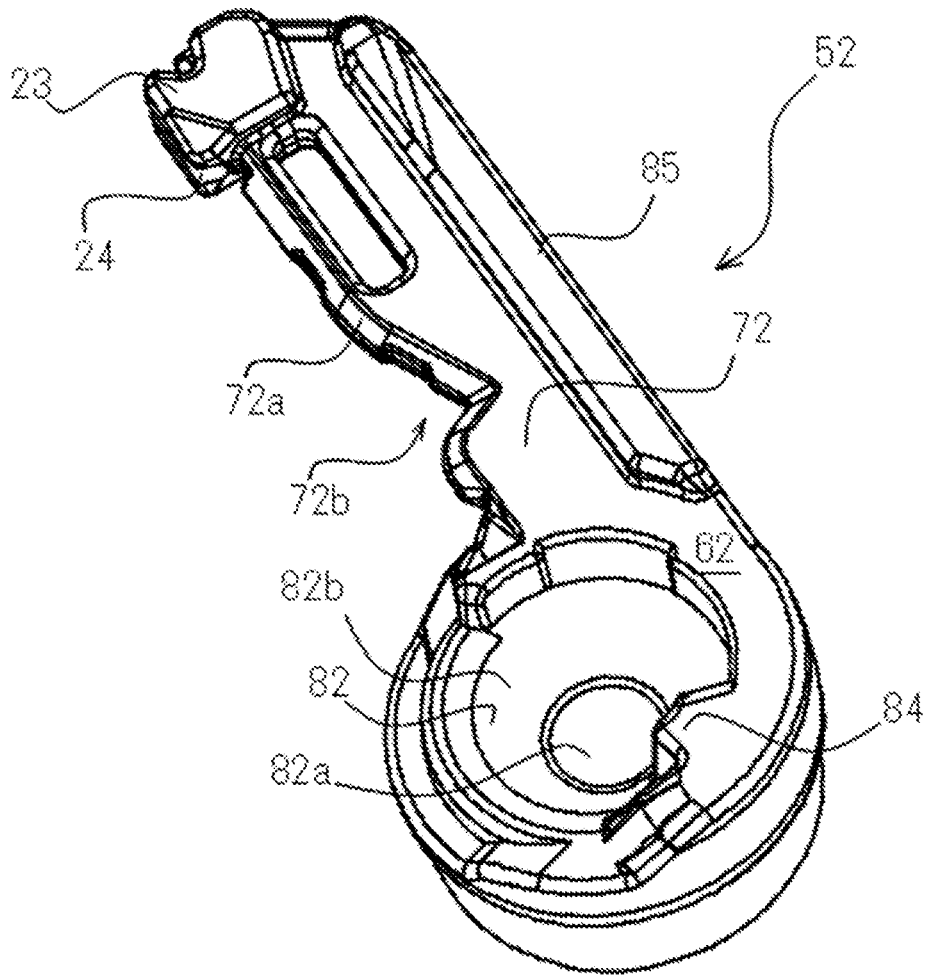

[Fig. 6]
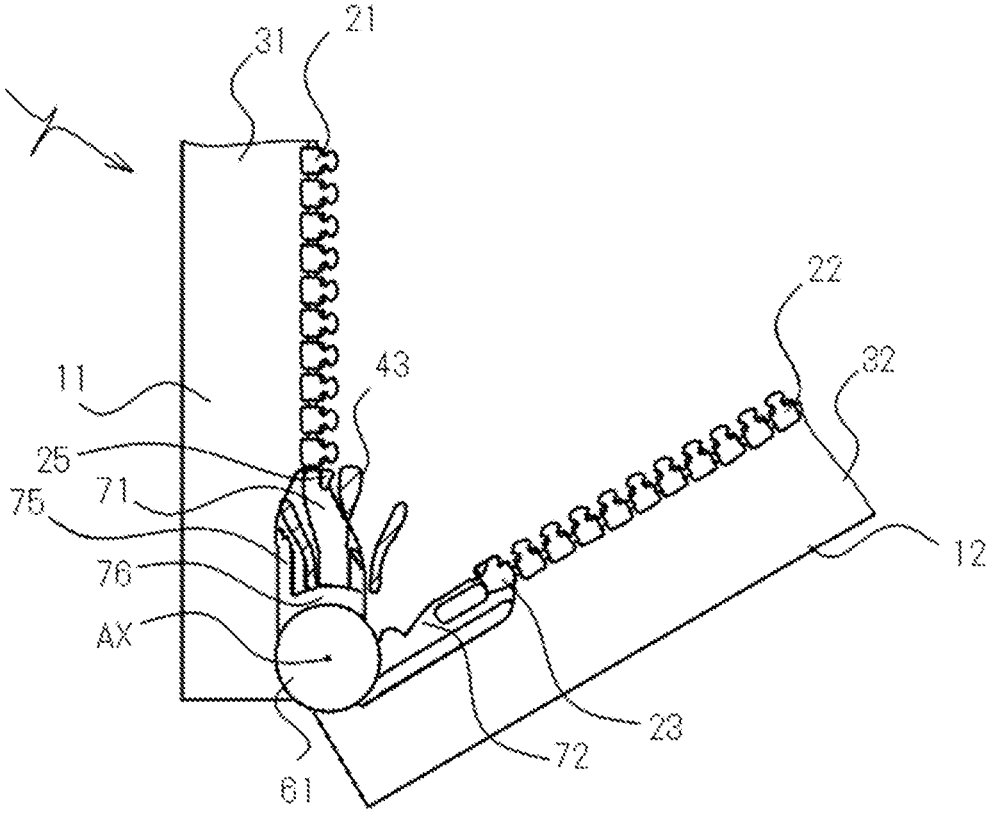

[Fig. 7]
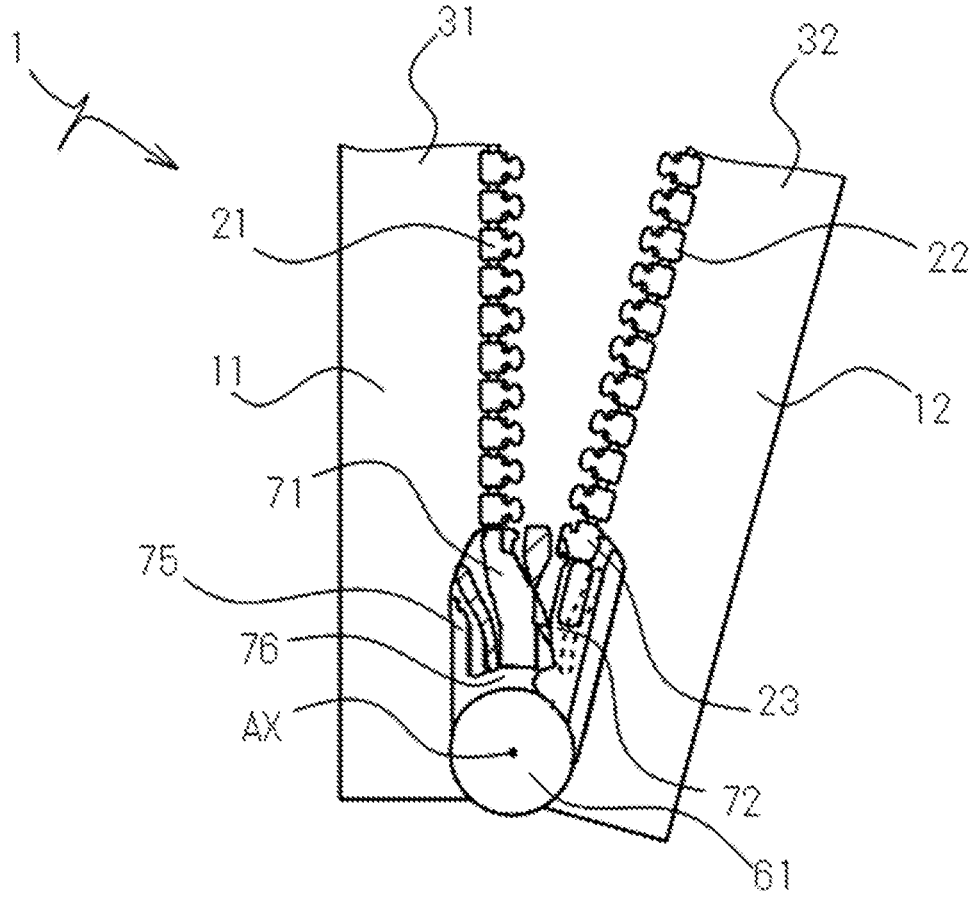

[Fig. 8]
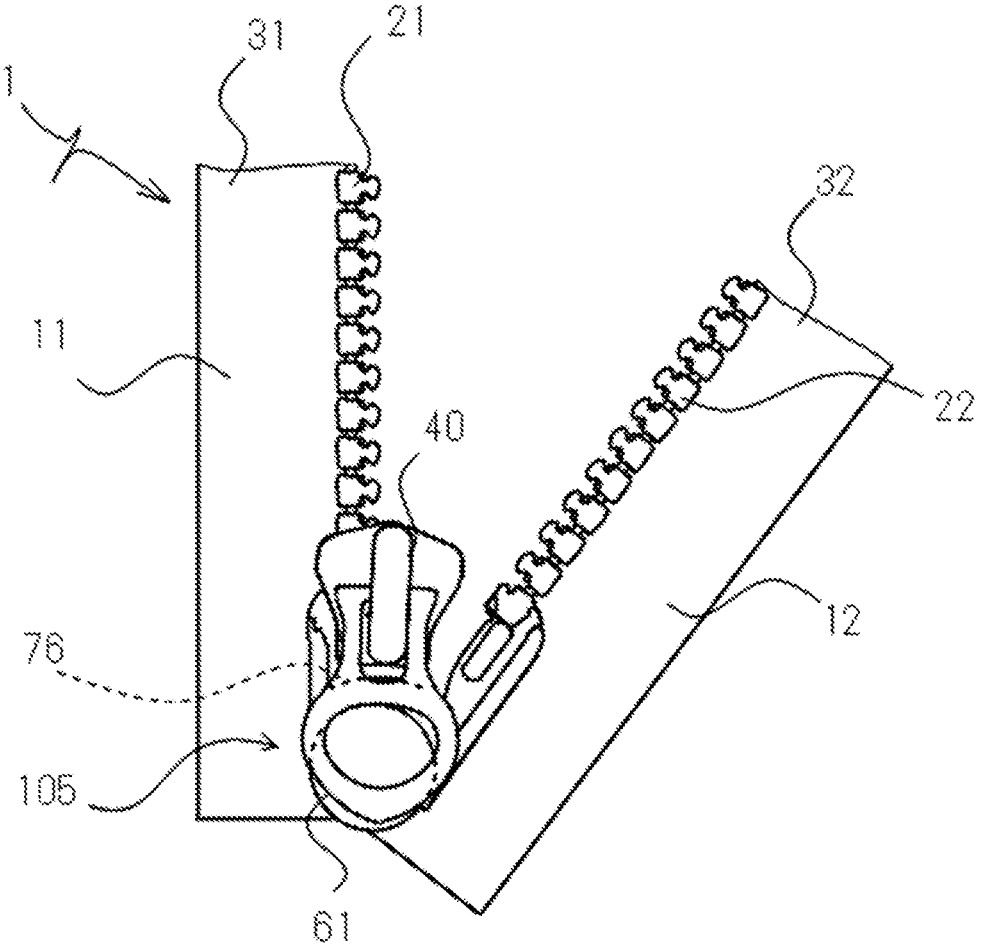

[Fig. 9]
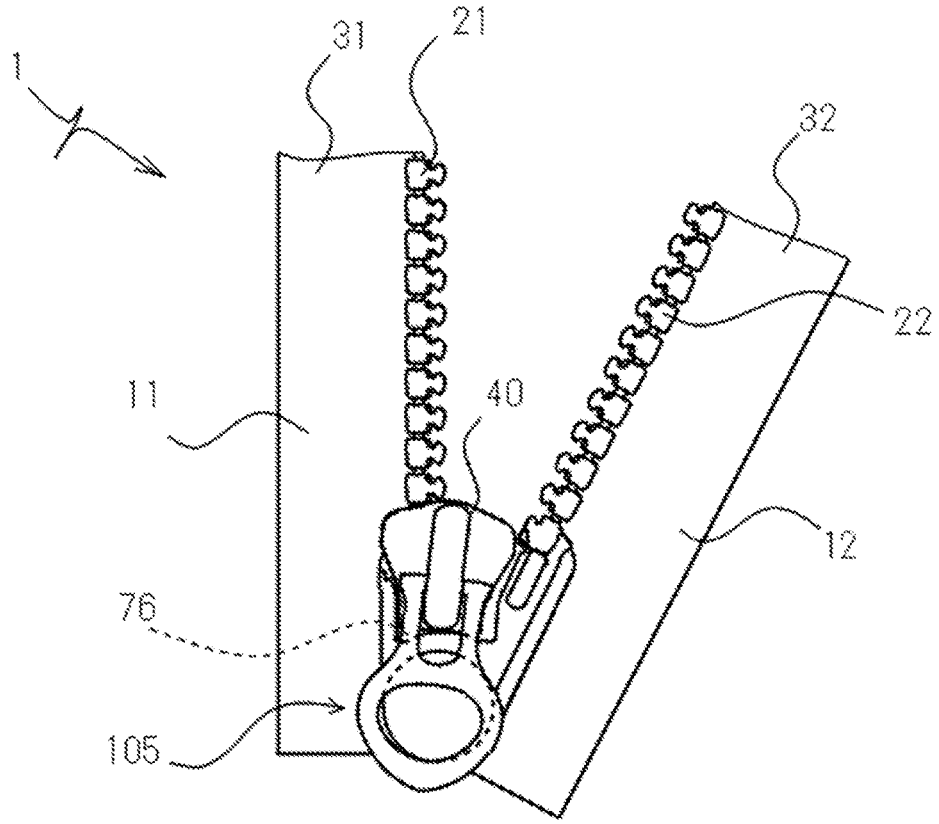
[Fig. 10]
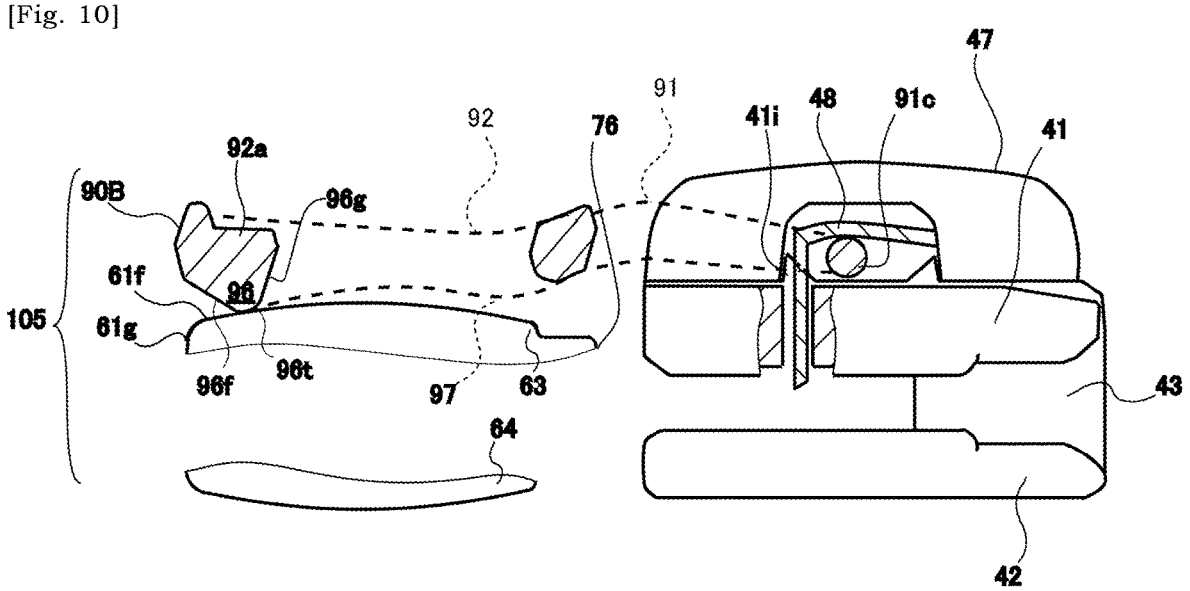

[Fig. 11]
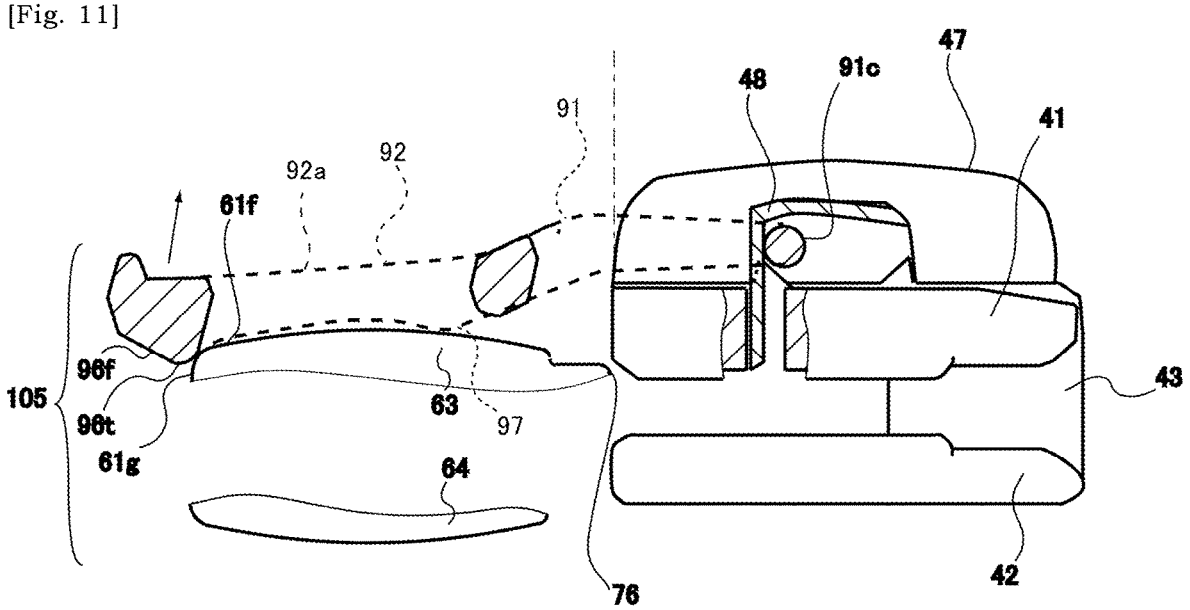
[Fig. 12]
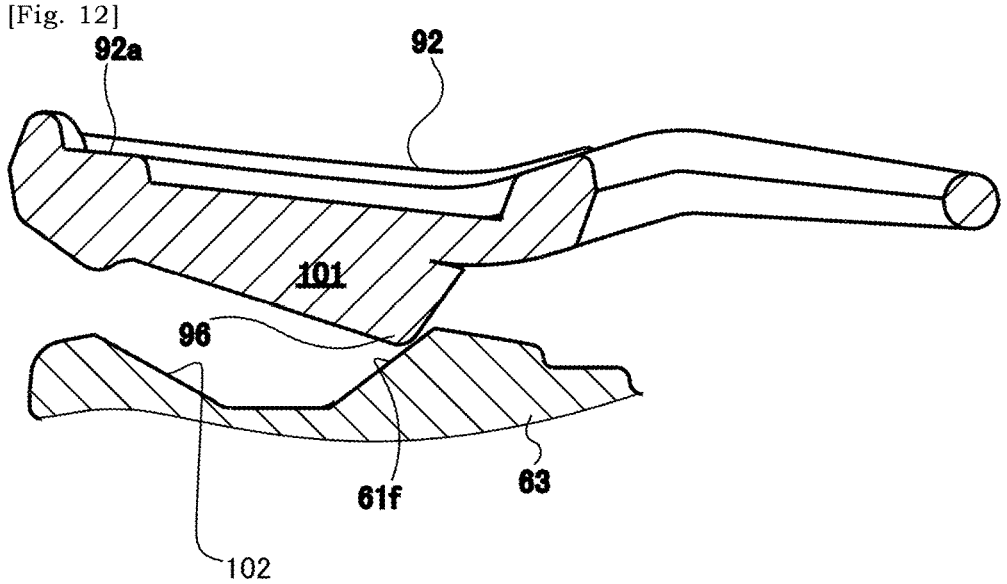

[Fig. 13]
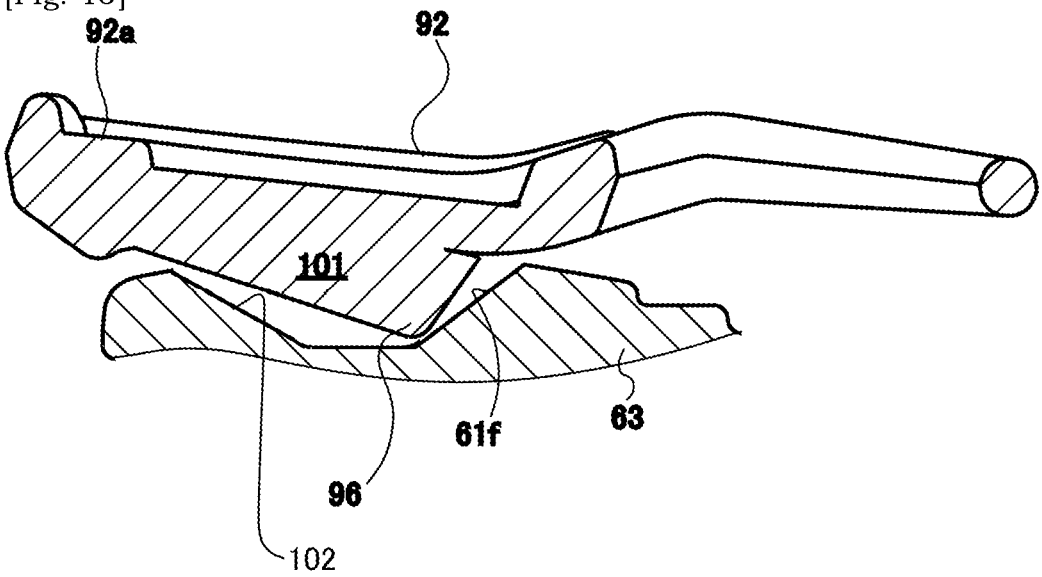
[Fig. 14]
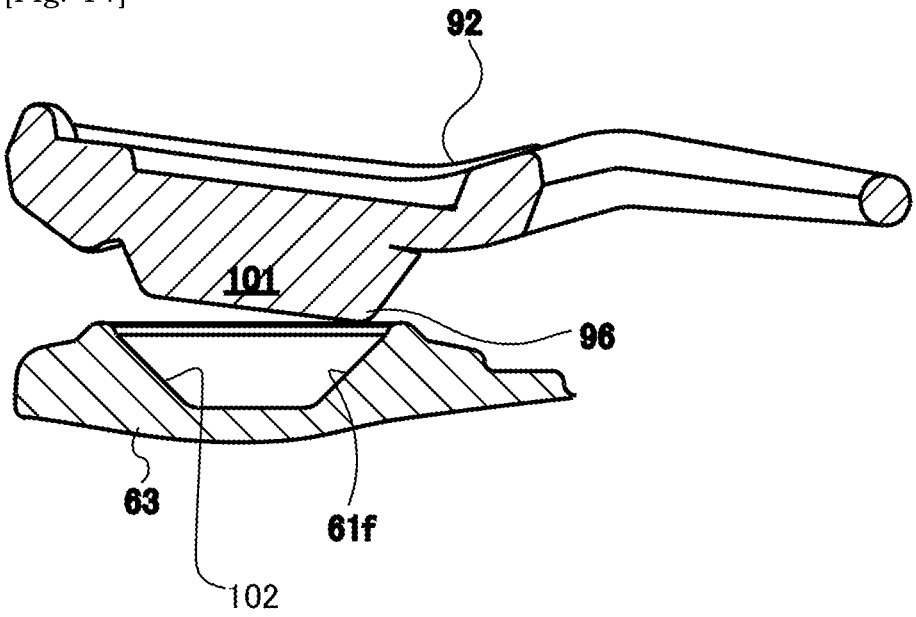

[Fig. 15]
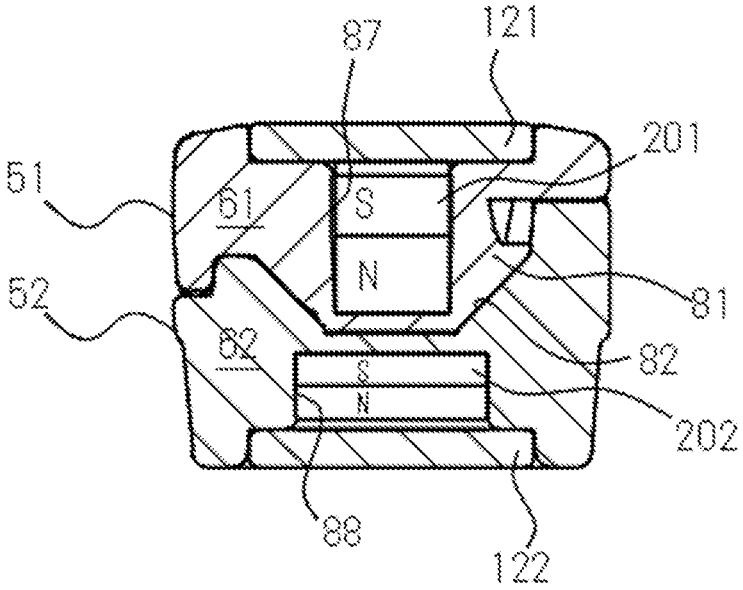

SLIDE FASTENER

TECHNICAL FIELD

The present disclosure is related to slide fasteners.

BACKGROUND ART

Patent literature 1 discloses a separable stop for slide fastener. In this stop, a sliding portion slides on an arc-shaped sloped surface such that main bodies rotate relative to one another (See FIGS. 14 and 15) and an axial spacing between the main bodies changes (See FIGS. 16 and 17). Patent literature 2 teaches that a magnet is used to facilitate relative rotation of first and second bases. Unlike Patent literatures 1 and 2, Patent literature 3 discloses that an insertion member is operated by hand and inserted inside a slider.

CITATION LIST

Patent Literature

[Patent literature 1] International Publication No. 2018/061208

[Patent literature 2] International Publication No. 2019/175944

[Patent literature 3] Japanese Patent No. 4152216

SUMMARY

Technical Problem

In cases where a slider is not placed in a correct parking position, there is a possibility that first and second stop members are not coupled smoothly and considerable time and labor may be consumed for closing a slide fastener. In view of such an issue, the present inventors have newly identified a significance of supplying a slide fastener that contributes to smoothly couple the first and second stop members.

Solution to Problem

Slide fastener according to an aspect of the present disclosure includes: a first fastener stringer in which a first fastener element is arranged at a side-edge portion of a first fastener tape; a second fastener stringer in which a second fastener element is arranged at a side-edge portion of a second fastener tape; a slider including a slider body and a pull tab attached to the slider body, the slider body movable forward to engage the first and second fastener elements and movable rearward to disengage the first and second fastener elements in accordance with operation of the pull tab; a first stop member positioned adjacently to the first fastener element in the first fastener stringer, the first stop member including a first insert inserted inside the slider body via a rear mouth of the slider and a first base arranged rearward of the first insert; and a second stop member positioned adjacently to the second fastener element in the second fastener stringer, the second stop member including a second insert inserted inside the slider body via a slit communicating between a front mouth and the rear mouth of the slider and a second base arranged rearward of the second insert. The pull tab includes a pull tab main portion operated so as to move the slider body forward or rearward. The first base is sandwiched between the second base and the pull tab main portion to form a stack in which the second base, the first base and the pull tab main portion are stacked in this order. The pull tab main portion and the first base are configured such that the pull tab main portion moves rearward to cause rearward movement of the slider body as the stack is sandwiched by human fingers in its stack direction while the first insert has been not fully inserted inside the slider body.

In some embodiments, the pull tab main portion includes first sliding portion that slides on the first base. Alternatively, in some embodiments, the first base comprises a sliding portion that slides on the pull tab main portion.

In some embodiments, the first base includes a first sloped surface on which the first sliding portion descends rearward as the stack is sandwiched by human fingers in its stack direction. The first sliding portion may be positioned rearward of and adjacently to a peripheral side surface of the first base after descending across the first sloped surface. The pull tab main portion may include at least one contact portion that is in contact with the first base so as to stabilize a pose of the pull tab on the first base when the first sliding portion is positioned rearward of and adjacently to the peripheral side surface of the first base.

In some embodiments, a pose of the pull tab on the first base is most stable when the first sliding portion is positioned rearward of and adjacently to the peripheral side surface of the first base. The pull tab may be positioned at its rearmost position relative to the slider body of the slider when the first sliding portion is positioned rearward of and adjacently to the peripheral side surface of the first base.

In some embodiments, the slider further includes a locking pawl attached to the slider body, and the locking pawl is in a lifted pose in accordance with force applied from the pull tab when the first sliding portion is positioned rearward of and adjacently to the peripheral side surface of the first base.

In some embodiments, the first base includes a discoid portion on which the pull tab main portion is placed, and the pull tab main portion includes a frame extending along a contour of the discoid portion with the pull tab main portion placed on the discoid portion of the first base.

In some embodiments, the first stop member further includes a stopper wall configured to define a correct parking position for the slider body on the first stop member, and the slider body is in contact with the stopper wall while the first insert has been fully inserted inside the slider body.

In some embodiments, a protrusion is formed in one of the pull tab main portion and the first base, and a recess is formed in the other one of the pull tab main portion and the first base, and the pull tab moves rearward to move the slider rearward as the stack is sandwiched by human fingers in its stack direction so as to allow the protrusion to be at least partially received in the recess before the first insert is fully inserted inside the slider body. The protrusion may be formed in the pull tab main portion and the recess may be formed in the first base.

In some embodiments, the first and second bases are configured such that the second insert pivots toward the slit of the slider as the stack is sandwiched by human fingers in its stack direction.

In some embodiments, one of the first and second bases has a second sloped surface sloped in an arc about an axial line with respect to pivoting of the second insert, and the other one of the first and second bases has a second sliding portion that slides on the second sloped surface.

Advantageous Effects of Invention

According to an aspect of the present disclosure, a slide fastener can be supplied that contributes to smoothly couple first and second stop members.

BRIEF DESCRIPTION OF DRAWINGS

FIG. 1 is a schematic elevational view of a rear end portion of a closed slide fastener according to an aspect of the present disclosure.

FIG. 2 is a side view of a slider for opening and closing a slide fastener according to an aspect of the present disclosure.

FIG. 3 is a schematic elevational view of a pull tab according to an aspect of the present disclosure, illustrating a sliding portion positioned on a free end of the pull tab.

FIG. 4 is a schematic perspective view of a first stop member, showing the lower-side structure of the first stop member.

FIG. 5 is a schematic perspective view of a second stop member, showing the upper-side structure of the second stop member.

FIG. 6 is a diagram for illustrating the operation of closing a slide fastener according to an aspect of the present disclosure, a slider body in contact with a stopper wall at a correct parking position.

FIG. 7 is a diagram for illustrating the operation of closing a slide fastener according to an aspect of the present disclosure, a second insert of the second stop member inserted inside the slider body at the correct parking position.

FIG. 8 is a schematic diagram illustrating a condition in which a pull tab main portion of the pull tab is placed on a first base of the first stop member in the slide fastener according to an aspect of the present disclosure, the slider body not placed at the correct parking position and an interspace formed between the slider body and the stopper wall.

FIG. 9 is a schematic diagram illustrating a condition in which the pull tab main portion of the pull tab is placed on the first base of the first stop member in the slide fastener according to an aspect of the present disclosure, the slider body placed at the correct parking position and in contact with the stopper wall.

FIG. 10 is a schematic diagram, corresponding to FIG. 8, illustrating relative positions to the first base of the pull tab main portion and the slider.

FIG. 11 is a schematic diagram, corresponding to FIG. 9, showing relative positions to the first base of the pull tab main portion and the slider.

FIG. 12 is a schematic illustration of implementation in which a protrusion is formed in the pull tab main portion of the pull tab and a recess is formed in the first base.

FIG. 13 is a schematic illustration of condition in which the protrusion of the pull tab main portion of the pull tab is received in the recess of the first base.

FIG. 14 is a schematic illustration of implementation in which a protrusion is formed in the pull tab main portion of the pull tab and a recess is formed in the first base.

FIG. 15 is a schematic illustration of implementation in which the first and second bases of the first and second stop members are magnetically attracted.

DESCRIPTION OF EMBODIMENTS

Hereinafter, various embodiments and features will be described with reference to FIGS. 1 to 15. A skilled person would be able to combine respective embodiments and/or respective features without requiring excess descriptions, and would appreciate synergistic effects of such combinations. Overlapping descriptions among the embodiments would be basically omitted. Referenced drawings are mainly for describing inventions, and may possibly be simplified for the sake of convenience of illustration. Individual features will be understood as a universal feature which is not only effective to slide fasteners disclosed in the present specification but also effective to other various slide fasteners not disclosed in the present specification.

As illustrated in FIG. 1, a slide fastener 1 has a pair of left and right fastener stringers (first and second fastener stringers) 31 and 32, and a slider 4 (See FIG. 2) for opening and closing the pair of left and right fastener stringers 31 and 32. The fastener stringer 31 has a fastener tape (first fastener tape) 11 and a fastener element (first fastener element) 21 arranged at a side-edge portion of the fastener tape 11. The fastener stringer 32 has a fastener tape (second fastener tape) 12 and a fastener element (second fastener element) 22 arranged at a side-edge portion of the fastener tape 12.

The fastener tape 11,12 is a flexible woven fabric, knitted fabric or mixture thereof, and has a thickness defined by a pair of tape surfaces. The fastener element 21,22 may be configured by an arrangement of resin-made or metal-made elements or by a coil of wound monofilament. The fastener elements 21 and 22 are secured to opposed side-edge portions of the fastener tapes 11 and 12. Core threads may be provided at the opposed side-edge portions of the fastener tapes 11 and 12 for firmer securing of the fastener elements 21 and 22.

Paired left and right stop members 51,52 are positioned adjacently to the fastener elements 21,22 in the fastener stringers 31,32. The left-side stop member (first stop member) 51 has a first insert 71 inserted inside a slider body 40 via a rear mouth of the slider body 40, and a first base 61 arranged rearward of the first insert 71. The right-side stop member (second stop member) 52 has a second insert 72 inserted inside the slider body 40 via a slit 46 communicating between a front mouth 44 and the rear mouth 45 of the slider body 40, and a second base 62 arranged rearward of the second insert 72.

For example, the first base 61 and the second base 62 are shaped identically or analogously (e.g. shaped like a disk) and are stacked in the up-down direction. In accordance with the stacking of the first base 61 and the second base 62, the second insert 72 may automatically pivot toward the slit 46 of the slider body 40. In another case, the first base 61 and the second base 62 are stacked, followed by the second insert 72 operated by human to move toward the slit 46 of the slider body 40. Needless to say, embodiments are envisioned where, with respect to the left-right direction, the stop members 51 and 52 are interchanged with each other.

As shown in FIG. 2, the slider 4 has a slider body 40 and a pull tab 90 attached to the slider body 40. In accordance with operation of the pull tab 90, the slider body 40 moves forward or rearward. The pull tab 90 is slanted obliquely forward relative to the slider body 40 and pulled forward, and the slider body 40 can move forward. The pull tab 90 is slanted obliquely rearward relative to the slider body 40 and pulled rearward, and the slider body 40 can move rearward. The slider body 40 moves forward such that the fastener elements 21 and 22 are engaged and the fastener stringers 31 and 32 are closed. The slider body 40 moves rearward such that the fastener elements 21 and 22 are disengaged and the fastener stringers 31 and 32 are opened (separated). In the present description, Front-rear direction is understood based on such movement of the slider 4. Up-down direction is orthogonal to Front-rear direction and the tape surface of the fastener tape 11,12. Left-right direction is orthogonal to Front-rear direction and Up-down direction. Front-rear direction may be identical to a vertical direction but not necessarily be limited to this.

The slider body 40 has a top wing 41, a bottom wing 42 arranged to be opposed to the top wing 41, and a coupling pillar 43 that couples the top wing 41 and the bottom wing 42 at their front end portions. The slider body 40 has a pair of left and right front mouths 44 that sandwich the coupling pillar 43, and a rear mouth 45 positioned at the opposite side of the front mouths 44 in the front-rear direction. When the slider body 40 moves forward, the left and right fastener elements 21 and 22 enter into the inside of the slider body 40 via the left and right front mouths 44 and are engaged inside the slider body 40. The engaged left and right fastener elements 21 and 22 move out of the slider body 40 via the rear mouth 45 as the slider body 40 moves further forward. When the slider body 40 moves rearward, the engaged left and right fastener elements 21 and 22 enter into the inside of the slider body 40 via the rear mouth 45 of the slider body 40 and are disengaged by the coupling pillar 43 of the slider body 40. The separate left and right fastener elements 21 and 22 move out of the slider body 40 via the left and right front mouths 44, respectively, as the slider body 40 moves further rearward.

The top wing 41 is provided with a pair of left and right flanges 41*f*, and the bottom wing 42 is also provided with a pair of left and right flanges 42*f*. The slit 46, communicating the front mouth 44 and the rear mouth 45, is formed between the flange 41*f* of the top wing 41 and the flange 42*f* of the bottom wing 42. The fastener tape is inserted in the slit 46. Embodiments are envisioned where only one of the top wing 41 and the bottom wing 42 is provided with the flange.

The pull tab 90 can be attached to the slider body 40 in various manners, and should not be limited to one illustrated in FIG. 2 and the like. In some cases including the case of FIG. 2, the pull tab 90 is mounted onto the slider body 40 and the locking pawl 48 is attached onto the slider body 40, and the cap 47 is secured to the slider body 40, thereby the pull tab 90 is attached to the slider body 40. Note that, the cap 47 can be referred to as a pull-attachment column generally but here, it is defined as a cap considering that the locking pawl 48 is housed therein.

The locking pawl 48 may be a blade spring bent at least one location and having a securement portion (not-illustrated) secured to the slider body 40 and a locking end 48*p* at the opposite side of the securement portion. The locking pawl 48 can shift from an initial pose to a lifted pose in accordance with operation of the pull tab 90. When the locking pawl 48 is in the initial pose, the locking end 48*p* projects into a passage for the fastener elements inside the slider body 40. If the slider body 40 were provided onto the fastener elements, the locking end 48*p* of the locking pawl 48 would be in contact with the fastener element, preventing the slider body 40 from moving (e.g. rearward) in the front-rear direction. When the locking pawl 48 is in the lifted pose, the locking end 48*p* of the locking pawl 48 would not be in contact with the fastener element, and the slider body 40 would be able to freely move in the front-rear direction. Note that, when no external force is applied to the locking pawl 48 via the pull tab 90, the locking pawl 48 would be in the initial pose in accordance with its spring characteristic.

The pull tab 90 has a base end 90A and a free end 90B, and is attached to the slider body 40 so as to swing back and forth about the base end 90A. The pull tab 90 has an attachment base 91 and a pull tab main portion 92. The attachment base 91 of the pull tab 90 is attached to the slider body 40 (e.g. to its pull-attachment column). The pull tab main portion 92 is attached to the slider body 40 via the attachment base 91. The attachment base 91 is a portion for attachment of the pull tab 90 to the slider body 40. The pull tab main portion 92 is a portion operated by machine such as a gripper or human to move the slider body 40 forward or rearward. The pull tab main portion 92 is typically nipped by human fingers e.g. thumb and index finger. The pull tab main portion 92 may be dimensioned larger than the attachment base 91 so as to be suitably nipped by human fingers.

The attachment base 91 has a pair of left and right bars 91*a*,91*b* and a connecting rod 91*c* coupling the bars 91*a* and 91*b*. The bar 91*a*,91*b* extend substantially in parallel, facilitating the arrangement of the pull tab main portion 92 away from the connecting rod 91*c*, not necessarily limited to this though. The thickness TH8 (See FIG. 2) of the bar 91*a*,91*b* gradually increase toward the free end 90B of the pull tab 90. This facilitates increased thickness of the pull tab main portion 92, allowing easier arrangement of various functional portions (a sliding portion 96 and a contact portion 97 described below).

The pull tab main portion 92 is a portion placed onto the first base 61 at the opposite side of the second base 62 when the first base 61 and the second base 62 are stacked in order to close the left and right fastener stringers 31 and 32. When the first base 61 is sandwiched between the second base 62 and the pull tab main portion 92, a stack 105 is configured in which the second base 62, the first base 61 and the pull tab main portion 92 are stacked in this order. The stack 105 has a three-layer structure of the second base 62, the first base 61 and the pull tab main portion 92, but should not be limited to this. In a case where another pull tab is attached to the bottom wing 42 of the slider body 40, the stack 105 will have a four-layer structure including a pull tab main portion of another pull tab.

In some cases, the pull tab main portion 92 has an annular frame 92*a*. When the pull tab main portion 92 is placed on a discoid portion 63 of the first base 61 described below, the frame 92*a* extends along a contour of the discoid portion 63, for example, at the radially outward position thereof. The thickness TH9 (See FIG. 2) of the frame 92*a* may gradually increase toward the free end 90B of the pull tab 90. This allows the frame 92*a* to have a sufficient thickness in the free end 90B of the pull tab 90, allowing the sliding portion 96 described below to be arranged in the frame 92*a* without difficulty. Formed in the pull tab main portion 92 is an opening 92*s* shaped like an oval and surrounded by the frame 92*a*. Embodiments are envisioned where the opening 92*s* of the pull tab main portion 92 is in communication with the substantially rectangular opening 91*s* in the attachment base 91.

In a condition where the pull tab 90 is laid down rearward, the pull tab main portion 92 includes a portion offset downward relative to the attachment base 91 at the side of the free end 90B of the pull tab 90. This facilitates more reliable contact between the pull tab main portion 92 and the first base 61 of the first stop member 51. The amount of offset may be roughly equal to the diameter TH7 of the connecting rod 91*c* of the attachment base 91. For example, the pull tab main portion 92 has a flat portion 92*i* at the side of the free end 90B of the pull tab 90 and a slant portion 92*j* positioned between the flat portion 92*i* and the attachment base 91. A plane PL91 in which the attachment base 91 is present and a plane PL92 in which the flat portion 92*i* of the pull tab main portion 92 is present are arranged non-parallel to each other separately. At the instance of FIG. 2, the plane PL92 is offset downward relative to the plane PL91.

The first insert 71 of the first stop member 51 extends between the first base 61 and the fastener element 21 along the front-rear direction. The second insert 72 of the second stop member 52 extends between the second base 62 and the fastener element 22 along the front-rear direction. The first insert 71 has a groove 73 (See FIG. 4) into which the second insert 72 is inserted. The groove 73 extends along the front-rear direction and is open at the front-side, the rear-side and the right-side. In a condition where the first insert 71 has been fully inserted inside the slider body 40, the groove 73 receives the second insert 72 having entered inside the slider body 40 via the right-side slit 46 of the slider body 40. The second insert 72 is inserted into the groove 73 of the first insert 71, restricting the up-down displacement of the second insert 72.

Stopper wall 76 is provided in the first stop member 51, for example, at a position between the first insert 71 and the first base 61. The stopper wall 76 is provided to allow the slider body 40 to be placed at a correct parking position on the first stop member 51. When the slider body 40 moves rearward and touches the stopper wall 76, the first insert 71 will be fully inserted inside the slider body 40 and the slider body 40 will be placed at the correct parking position. As described below with reference to FIGS. 6 and 7, when the slider body 40 is at the correct parking position, it would be possible to smoothly insert the second insert 72 into the inside of the slider body 40. The stopper wall 76 may have at least one of a top portion with which the top wing 41 of the slider body 40 can be in contact and a bottom portion with which the bottom wing 42 of the slider body 40 can be in contact. Each of these portions extends along the left-right direction. Embodiments are envisioned where the stopper wall 76 touches a portion other than the rear end portion of the slider body 40 to prevent the slider body 40 from moving rearward. Note that, when the slider body 40 is not placed at the correct parking position, the first insert 71 is not fully (e.g. partially) inserted into the inside of the slider body 40.

Guide 75 may be provided in the first stop member 51. The guide 75 protrudes up and down relative to the fastener tape and extends along the front-rear direction. Groove 77 is formed between the first insert 71 and the guide 75 to which the flange 41*f*,42*f* of the slider body 40 is inserted. The guide 75 visually indicates the parking position for the slider body 40, but can be omitted. Resin layer covering the surface of fastener tape may be formed or not formed between the guide 75 and the first insert 71.

The first base 61 has a discoid portion 63, an axial portion 81, and a sloped surface (second sloped surface) 83. The axial portion 81 is arranged on the bottom surface of the discoid portion 63 so as to project downward. The axial portion 81 has a portion having a diameter reduced toward its terminal portion 86. The axial portion 81 has a terminal surface 81*a* of the terminal portion 86 thereof and a peripheral surface 81*b* arranged about the terminal surface 81*a*. Stimulus otherwise given to human skin may be reduced by flattening the terminal surface 81*a*. The sloped surface 83 extends in an arc about the rotational axial line AX (See FIGS. 6 and 7) with respect to pivoting of the second insert 72. The sloped surface 83 extends in an arc about the rotational axial line AX but may possibly extend in the entire circumference about the rotational axial line AX. The sloped surface 83 is arranged to slant between the peripheral surface 81*b* of the axial portion 81 and the bottom surface of the discoid portion 63. The sloped surface 83 contributes to the conversion of the displacement of the second base 62 along the axial direction of the rotational axial line AX to the rotation of the second base 62 about the rotational axial line AX.

The second insert 72 of the second stop member 52 includes a portion that can enter into the inside of the slider body 40 via the slit 46 of the slider body 40. The second insert 72 has, for example, a flat plate having a thickness suitable for passing through the slit 46 of the slider body 40. As described above, the second insert 72 is inserted into the groove 73 of the first insert 71. Beam 85 may be provided in the second stop member 52. The beam 85 projects up and down relative to the second insert 72 and extends along the front-rear direction. The second insert 72 pivots toward the slit 46 of the slider body 40, and this ends as the beam 85 collides with the flanges 41*f*,42*f* of the slider body 40. When opening the slide fastener 1, the slider body 40 moves rearward and collides with the beam 85, and the beam 85 is pushed by the slider body 40 and pivots in a direction away from the slider body 40.

Third fastener element 23 may be provided in the second stop member 52. The third fastener element 23 is coupled to the front end of the second insert 72 and is positioned between the second insert 72 and the fastener element 22. When the second insert 72 is inserted into the inside of the slider body 40 via the slit 46 of the slider body 40, the third fastener element 23 is positioned in front of and adjacent to the front mouth 44 of the slider body 40. The third fastener element 23 enters into the inside of the slider body 40 as the slider body 40 moves forward, and then would be engaged with the fastener element 21 inside the slider body 40. Groove 24 may be formed in the third fastener element 23, and an insertion portion 25 may be provided in the first insert 71. The insertion portion 25 is inserted into the groove 24 of the third fastener element 23, suppressing the separation between the front end of the first stop member 51 and the front end of the second stop member 52 in the up-down direction.

The second base 62 has a receiving portion 82 that receives the axial portion 81 of the first base 61, and a sliding portion (second sliding portion) 84 that slides on the sloped surface 83 of the first base 61. The receiving portion 82 has an opening 82*a* opposed to the terminal surface 81*a* of the axial portion 81 and a peripheral surface 82*b* opposed to the peripheral surface 81*b* of the axial portion 81. The opening 82*a* may be filled with resin portion such that a bottom portion is formed instead. The sliding portion 84 is provided to protrude into the internal space of the receiving portion 82, for example, protruding radially inward from the peripheral surface 82*b* of the receiving portion 82. When the first base 61 and the second base 62 are stacked, the sliding portion 84 protrudes radially inward toward the rotational axial line AX with respect to pivoting of the second insert 72.

Note that the axial portion 81 may be formed in the second base 62, and the receiving portion 82 may be formed in the first base 61. The sloped surface 83 may be formed in the second base 62, and the sliding portion 84 may be formed in the first base 61. The axial portion 81 and the receiving portion 82 are formed for a positioning purpose at the time of stacking the first base 61 and the second base 62 and/or enhanced rotational stability of the first base 61 and the second base 62. Embodiments are envisioned where the axial portion 81 and the receiving portion 82 are not formed in the first and second bases 61 and 62.

With reference to FIGS. 6 and 7, insertion of the second insert 72 into the inside of the slider body 40 will be discussed. When the first base 61 and the second base 62 are stacked and sandwiched by human fingers (e.g. thumb and index finger), the sliding portion 84 will be in contact with the sloped surface 83, and the sliding portion 84 descends the sloped surface 83. As the sliding portion 84 descends the sloped surface 83, the axial spacing between the first and second bases 61 and 62 will be reduced and the second base 62 rotates relative to the first base 61. As the second base 62 rotates, the second insert 72 connected to the second base 62 pivots toward the slit 46 of the slider body 40 about the rotational axial line AX and then enters into the inside of the slider body 40 via the slit 46. When the slider body 40 is moved forward while the second insert 72 has been inserted inside the slider body 40 as shown in FIG. 7, the second insert 72 is inserted into the groove 73 of the first insert 71, and the insertion portion 25 is inserted into the groove 24 of the third fastener element 23 and also the third fastener element 23 and the fastener element 21 are engaged.

As the instance of FIG. 6, the slider body 40 collides with the stopper wall 7, the slider body 40 is at the correct parking position and therefore the second insert 72 can smoothly enter into the inside of the slider body 40 via the slit 46 of the slider body 40 as shown in FIG. 7. However, in the instance where the first insert 71 is not fully inserted into the inside of the slider body 40 and the slider body 40 is positioned such that a slight distance is set at the front-side from the stopper wall 76 as shown in FIG. 8, it would be NOT possible for the second insert 72 to smoothly enter into the inside of the slider body 40 via the slit 46 of the slider body 40. In a case where the second stop member 52 is provided with third fastener element 23, the third fastener element 23 may collide with the flanges 41*f*,42*f* as the second insert 72 pivots, possibly moving the slider body 40 forward. In such a case, the amount of insertion of the first insert 71 inside the slider body 40 may be reduced further, and the slider body 40 may move to a position farther away from the stopper wall 76.

In the present embodiment, in view of the above point, the pull tab main portion 92 of the pull tab 90 and the first base 61 are configured such that the pull tab main portion 92 moves rearward to cause rearward movement of the slider body 40 as the stack 105 of the pull tab main portion 92, the first base 61 and the second base 62 is sandwiched by human fingers in its stack direction while the first insert 71 has been not fully inserted inside the slider body 40. Accordingly, as illustrated in FIG. 9, the slider body 40 is moved rearward until colliding with the stopper wall 76 so that the slider body 40 is located at the correct parking position, thereby facilitating more reliable or appropriate entry of the second insert 72 into the inside of the slider body 40. In the embodiments where the second insert 72 pivots toward the slit 46 of the slider body 40 as the sliding portion 84 descends the sloped surface 83, the movement of the slider body 40 back to the correct parking position and the pivoting of the second insert 72 toward the slit 46 of the slider body 40 can be simultaneously caused by sandwiching the stack 105 by human fingers.

In more particular, when the stack 105 is sandwiched in its stack direction (equal to the up-down direction) by thumb and index finger of right or left hand of human, the second base 62 is supported on the index finger cushion (distal segment of index finger) and the pull tab main portion 92 is pushed by the thumb onto the first base 61 and then the first base 61 is pushed toward the second base 62. When force is applied to the pull tab main portion 92 along the stack direction of the stack 105, it moves rearward which is a direction orthogonal to the stack direction of the stack 105. The pull tab 90 moves rearward simultaneously with this rearward displacement of the pull tab main portion 92, and the slider body 40 is entrained rearward by the pull tab 90. One can operate the first and second stop members 51 and 52 into the coupled condition just by one hand, thus surprisingly enhancing the operation of the slide fastener 1.

As a procedure, the pull tab main portion 92 of the pull tab 90 may be firstly placed onto the first base 61 and next, the first base 61 and the second base 62 are stacked. On the contrary, the first base 61 may be stacked onto the second base 62 and next, the pull tab main portion 92 of the pull tab 90 may be placed onto the first base 61. In a normal way of using the slide fastener 1, the front-rear direction matches the vertical direction. Therefore, except for cases where unique pull tabs 90 were used, the pull tab 90 may be automatically arranged onto the first base 61 due to gravity as shown in FIG. 8. In this case, there is no need to place the pull tab main portion 92 of the pull tab 90 onto the first base 61 as the pull tab main portion 92 of the pull tab 90 has been already placed onto the first base 61.

The pull tab main portion 92 and the first base 61 are appropriately shaped, respectively, to facilitate or to ensure rearward movement of the pull tab main portion 92 as force is applied from thumb along the stack direction (the up-down direction) of the stack 105. In some cases, the sliding portion (a first sliding portion) 96 is formed in the pull tab main portion 92, and the sliding portion 96 slides on the first base 61. Typically, as shown in FIG. 10, the sliding portion 96 may be a protruded portion having one or more sloped surfaces 96*f* slanting so as to reduce stimulus otherwise given to human fingers and/or having an edgeless (e.g. arc-shaped) terminal surface 96*t* to reduce stimulus otherwise given to human fingers. Needless to say, the sliding portion may be formed in the first base 61 and the sloped surface may be formed in the pull tab main portion 92 such that the pull tab main portion 92 moves rearward as receiving a force from the thumb the force along the stack direction (e.g. Up-down direction) of the stack 105.

Position, size and number of the sliding portion 96 may be variously determined. In the case of FIG. 10, the sliding portion 96 is formed in the free end 90B of the annular frame 92*a* of the pull tab main portion 92. When the pull tab main portion 92 is placed onto the first base 61, it is likely that the sliding portion 96 is placed onto the first base 61. The sloped surface (first sloped surface) 61*f* on which the sliding portion 96 slides may be formed in the discoid portion 63 of the first base 61. When the stack 105 is sandwiched by human thumb and index finger, the sliding portion 96 of the pull tab main portion 92 receives the force along the stack direction of the stack 105 and descends the sloped surface 61*f* in the first base 61 to move rearward. The entirety of the pull tab 90 moves rearward together with the sliding portion 96, and the slider body 40 is entrained rearward by the pull tab 90. As a result of this, the slider body 40 collides with the stopper wall 76 and is placed at the correct parking position as shown in FIG. 11. Note that, it is assumed that the force may be applied to the pull tab main portion 92 from the thumb along a vector sum of the stack direction of the stack 105 and the rear direction, and the same effect can be obtained.

After descending across the sloped surface 61*f*, the sliding portion 96 is placed rearward of and adjacently to the peripheral side surface 61*g* of the first base 61 (the peripheral side surface of the discoid portion). At this instance, the discoid portion 63 (i.e. a protrusion) may be fitted with the annular frame 92*a* (i.e. a recess). Therefore, it could be described that the rearward movement of the pull tab main portion 92 when the stack 105 is sandwiched by human fingers is performed for a purpose of engaging/fitting the annular frame 92*a* (the recess) with the discoid portion 63 (the protrusion).

When the sliding portion 96 is placed rearward of and adjacently to the peripheral side surface 61*g* of the first base 61, the contact portion 97 of the pull tab main portion 92 is in contact with the first base 61 such that the pose of the pull tab 90 is stabilized (most-stabilized in some cases) on the first base 61. Position, size and the number of the contact portion 97 in the pull tab main portion 92 may be variously determined. In some cases, the contact portion 97 is positioned closer to the attachment base 91 than the free end 90B in the annular frame 92*a* as shown in FIG. 11. When the slider body 40 is positioned slightly forward from the correct parking position as shown in FIG. 10, the contact portion 97 is not in contact with the top surface of the first base 61 (the discoid portion 63). This indicates that the pose of the pull tab main portion 92 is unstable on the first base 61. Seemingly, this appears to be a negative feature, but beneficial in promoting the motion of the pull tab 90 on the first base 61 shifting toward the more stable pose on the first base 61.

When the sliding portion 96 is placed rearward of and adjacently to the peripheral side surface 61*g* of the first base 61, the pull tab 90 may be positioned at its rearmost position relative to the slider body 40. The sliding portion 96 may move rearward further away from the peripheral side surface 61*g* of the first base 61, avoiding or suppressing the pull tab 90 from taking an unstable pose on the first base 61.

It should be noted that the slider body 40 can take various shapes as long as entrained by the pull tab 90 for rearward movement. As shown in FIG. 10, the locking pawl 48 is attached to the slider body 40, and a projection 41*i* is formed on the top surface of the top wing 41 of the slider body 40. The connecting rod 91*c* of the attachment base 91 of the pull tab 90 ascends a sloped surface of the projection 41*i* when the pull tab 90 moves rearward. The locking pawl 48 is pushed rearward by the connecting rod 91*c*, and the locking pawl 48 shifts from the initial pose to the lifted pose. The slider body 40 moves rearward in accordance with the force applied from the connecting rod 91*c* via the locking pawl 48 and the cap 47. When the stack 105 is released from human fingers, the connecting rod 91*c* is pushed forward due to the spring effect of the locking pawl 48, the pull tab 90 moves forward and the free end 90B of the pull tab 90 moves upward (See an arrow in FIG. 11) from a downwardly sinking condition (FIG. 11). Accordingly, the operation of nipping and pulling forward the pull tab main portion 92 of the pull tab 90 would be smoothly performed after the operation of sandwiching the stack 105 by human fingers. This is a benefit of arrangement of the locking pawl 48 with the slider body 40. Note that, it is envisioned that a pair of projections 41*i* are formed at the left and right sides of the locking pawl 48, not necessarily limited to this though.

As described above, in the present embodiment, the pull tab main portion 92 of the pull tab 90 and the first base 61 are configured such that the pull tab main portion 92 moves rearward to cause rearward movement of the slider body 40 as the stack 105 of the pull tab main portion 92, the first base 61 and the second base 62 is sandwiched by human fingers in its stack direction while the first insert 71 has been not fully inserted inside the slider body 40. Accordingly, as illustrated in FIG. 9, the slider body 40 is moved rearward until colliding with the stopper wall 76 so that the slider body 40 is located at the correct parking position, thereby facilitating more reliable or appropriate entry of the second insert 72 into the inside of the slider body 40.

In a case where the stopper wall 76 is formed in the first base 61, the slider body 40 is not in contact with the stopper wall 76 forming an interspace therebetween while the first insert 71 has been not fully inserted inside the slider body 40.

Hereinafter several other embodiments will be discussed. As shown in FIG. 12, the opening 92*s* of the annular frame 92*a* of the pull tab main portion 92 of the pull tab 90 may be filled with a protrusion 101. A recess 102 is formed in the discoid portion 63 of the first base 61 corresponding to the protrusion 101. The recess 102 is configured to receive the protrusion 101 at least partially. When the stack 105 is sandwiched by human fingers, the sliding portion 96 of the protrusion 101 descends the sloped surface 61*f* of the recess 102, the pull tab 90 moves rearward and the slider body 40 moves rearward. When the sliding portion 96 has descended across the sloped surface 61*f* as shown in FIG. 13, the slider body 40 collides with the stopper wall 76. In this instance, the sliding portion 96 is positioned closer to the attachment base 91 of the pull tab 90.

As shown in FIG. 14, it would be possible, by fitting the protrusion 101 with the recess 102, to move the pull tab 90 rearward and to move the slider body 40 rearward to the correct parking position. There may be cases in which, when the stack 105 is sandwiched by human fingers, the sliding portion 96 of the protrusion 101 descends the sloped surface 61*f* of the recess 102, the pull tab 90 moves rearward and the slider body 40 moves rearward.

As shown in FIG. 15, a first magnet 201 may be encapsulated in the first base 61 and a second magnet 202 may be encapsulated in the second base 62. For example, the first magnet 201 is housed in a housing 87 of the axial portion 81 of the first base 61 and is capped by a first lid 121. The second magnet 202 is housed in a housing 88 directly under the bottom of the receiving portion 82 of the second base 62 and is capped by a second lid 122. When the first and second bases 61 and 62 are stacked, the sliding portion 84 descends the sloped surface 83 due to magnetic attraction effected between the first and second magnets 201 and 202, reducing the axial spacing between the first base 61 and the second base 62 and allowing the second insert 72 to pivot toward the slit 46 of the slider body 40.

When the slider body 40 is positioned at the incorrect parking position shown in FIG. 8, the second insert 72 pivots in accordance with magnetic attraction between the first and second bases 61 and 62, and the third fastener element 23 positioned at the front side of the second insert 72 may collide with the flanges 41*f*, 42*f* of the slider body 40. Based on the operation of sandwiching the stack 105 by human fingers, the slider body 40 move rearward to the correct parking position. Therefore, interference between the third fastener element 23 and the flanges 41*f*,42*f* would be cancelled, and the second insert 72 can enter into the inside of the slider body 40 via the slit 46 of the slider body 40.

Based on the above teachings, a skilled person in the art would be able to add various modifications to the respective embodiments and to the respective features. Reference numbers in Claims are just for reference and should not be referred for a purpose of narrowly construing the scope of claims.

REFERENCE NUMERALS

11 First fastener tape, 12 Second fastener tape, 21 First fastener element, 22 Second fastener element, 31 First fastener stringer, 32 Second fastener stringer, 4 Slider,

40 Slider body, 90 Pull tab, 91 Attachment base, 92 Pull tab main portion, 96 First sliding portion, 61*f* First sloped surface, 105 Stack That which is claimed is:

1. A slide fastener comprising:

a first fastener stringer in which a first fastener element is arranged at a side-edge portion of a first fastener tape;

a second fastener stringer in which a second fastener element is arranged at a side-edge portion of a second fastener tape;

a slider including a slider body and a pull tab attached to the slider body, the slider body movable forward to engage the first and second fastener elements and movable rearward to disengage the first and second fastener elements in accordance with operation of the pull tab;

a first stop member positioned adjacently to the first fastener element in the first fastener stringer, the first stop member including a first insert inserted inside the slider body via a rear mouth of the slider and a first base arranged rearward of the first insert; and a second stop member positioned adjacently to the second fastener element in the second fastener stringer, the second stop member including a second insert inserted inside the slider body via a slit communicating between a front mouth and the rear mouth of the slider and a second base arranged rearward of the second insert, wherein:

the pull tab includes a pull tab main portion operated so as to move the slider body forward or rearward, the first base is sandwiched between the second base and the pull tab main portion to form a stack in which the second base, the first base and the pull tab main portion are stacked in this order, and the pull tab main portion and the first base are configured such that the pull tab main portion moves rearward to cause rearward movement of the slider body as the stack is sandwiched by human fingers in its stack direction while the first insert has been not fully inserted inside the slider body.

2. The slide fastener of claim 1, wherein the pull tab main portion comprises a first sliding portion that slides on the first base.

3. The slide fastener of claim 2, wherein the first base comprises a first sloped surface on which the first sliding portion descends rearward as the stack is sandwiched by human fingers in its stack direction.

4. The slide fastener of claim 3, wherein the first sliding portion is positioned rearward of and adjacently to a peripheral side surface of the first base after descending across the first sloped surface.

5. The slide fastener of claim 4, wherein the pull tab main portion comprises at least one contact portion that is in contact with the first base so as to stabilize a pose of the pull tab on the first base when the first sliding portion is positioned rearward of and adjacently to the peripheral side surface of the first base.

6. The slide fastener of claim 4, wherein a pose of the pull tab on the first base is most stable when the first sliding portion is positioned rearward of and adjacently to the peripheral side surface of the first base.

7. The slide fastener of claim 4, wherein the pull tab is positioned at its rearmost position relative to the slider body of the slider when the first sliding portion is positioned rearward of and adjacently to the peripheral side surface of the first base.

8. The slide fastener of claim 4, wherein:

the slider further comprises a locking pawl attached to the slider body, and the locking pawl is in a lifted pose in accordance with force applied from the pull tab when the first sliding portion is positioned rearward of and adjacently to the peripheral side surface of the first base.

9. The slide fastener of claim 1, wherein:

the first base includes a discoid portion on which the pull tab main portion is placed, and the pull tab main portion includes a frame extending along a contour of the discoid portion with the pull tab main portion placed on the discoid portion of the first base.

10. The slide fastener of claim 1, wherein:

the first stop member further comprises a stopper wall configured to define a correct parking position for the slider body on the first stop member, and the slider body is in contact with the stopper wall while the first insert has been fully inserted inside the slider body.

11. The slide fastener of claim 1, wherein:

a protrusion is formed in one of the pull tab main portion and the first base, and a recess is formed in the other one of the pull tab main portion and the first base, and the pull tab moves rearward to move the slider rearward as the stack is sandwiched by human fingers in its stack direction so as to allow the protrusion to be at least partially received in the recess before the first insert is fully inserted inside the slider body.

12. The slide fastener of claim 11, wherein the protrusion is formed in the pull tab main portion and the recess is formed in the first base.

13. The slide fastener of claim 1, wherein the first and second bases are configured such that the second insert pivots toward the slit of the slider as the stack is sandwiched by human fingers in its stack direction.

14. The slide fastener of claim 13, wherein one of the first and second bases has a second sloped surface sloped in an arc about an axial line with respect to pivoting of the second insert, and the other one of the first and second bases has a second sliding portion that slides on the second sloped surface.

15. The slide fastener of claim 1, wherein the first base comprises a sliding portion that slides on the pull tab main portion.

* * * * *